US005673055A

United States Patent [19]

Hansen

[11] Patent Number: 5,673,055

[45] Date of Patent: Sep. 30, 1997

[54] ROSETTE-SHAPED MONOPOLE ANTENNA TOP-LOAD FOR INCREASED ANTENNA VOLTAGE AND POWER CAPABILITY

[75] Inventor: Peder M. Hansen, San Diego, Calif.

[73] Assignee: The United States of America as represented by the Secretary of the Navy, Washington, D.C.

[21] Appl. No.: 232,784

[22] Filed: Apr. 21, 1994

[51] Int. Cl.[6] ..... H01Q 9/00

[52] U.S. Cl. ..... 343/752; 343/890; 343/899

[58] Field of Search ..... 343/745, 749, 343/751, 853, 915, 890, 792.5, 828, 896, 899

[56] References Cited

U.S. PATENT DOCUMENTS

| | | | |
|---|---|---|---|
| 3,253,279 | 5/1966 | Tanner . | |
| 3,345,635 | 10/1967 | Fenwick et al. | 343/752 |
| 3,482,249 | 12/1969 | Mullaney | 343/752 |
| 3,604,008 | 9/1971 | Thowless | 343/752 |
| 3,696,430 | 10/1972 | Cory et al. | 343/792.5 |
| 3,838,429 | 9/1974 | Reggia . | |
| 4,313,121 | 1/1982 | Campbell et al. . | |
| 4,498,084 | 2/1985 | Werner et al. | 343/792.5 |
| 4,513,290 | 4/1985 | Lefevre et al. . | |
| 4,939,525 | 7/1990 | Brunner . | |
| 5,173,713 | 12/1992 | Yves et al. . | |

OTHER PUBLICATIONS

Devaney, T. E. et al, "Low–Frequency Top–Loaded Antennas", 22 Jun. 1966, Navy Electronics Laboratory Report 1381.

*Primary Examiner*—Donald T. Hajec
*Assistant Examiner*—Tan Ho
*Attorney, Agent, or Firm*—Harvey Fendelman; Michael A. Kagan; Peter A. Lipovsky

[57] ABSTRACT

In an umbrella top-loaded monopole (UTLM) antenna, the charge distribution on top-load radials increases approximately linearly from the top of the antenna because the activated wires are separating from the tower and each other at the same time they are getting closer to ground. The UTLM antenna of the invention incorporates a top-load configuration in which top-load elements, whether they be radiating or receiving, are arranged in the shape of frames that originate at the top of the antenna and that extend away from the antenna towards the antenna's base where, at those points of the configuration furthest from the antenna tower and closest to ground at least two top-load elements converge to shield each other and hence reduce charge density. The top-load frames may be arranged contiguously such as in a rosette configuration. The self-shielding effect of the invention permits an antenna to operate at considerably higher voltage. This top-load configuration can also show superior effective height and static capacitance as compared to the traditional UTLM antenna. Because of the efficiency offered by the invention, intrinsic bandwidth and radiated power can be superior to the typical UTLM antenna even with the same top-load voltage limit. Such results can be achieved with half of the traditional number of top-load high voltage insulators. This new top-load configuration also facilitates top-load element deicing.

13 Claims, 12 Drawing Sheets

ROSETTE-SHAPED MONOPOLE ANTENNA TOP-LOAD FOR INCREASED ANTENNA VOLTAGE AND POWER CAPABILITY

BACKGROUND OF THE INVENTION

This invention relates generally to antennas and without limitation thereto to top-loaded monopole antennas.

The monopole antenna, a vertical element fed against ground, has been used in radio (wireless) communication since the discovery of radio by Tesla and Marconi. The performance of these antennas can be improved by the addition of what is known as "top-loading". Top-loading is particularly effective in the case of electrically short antennas, that is, antennas short in height with respect to wavelength.

Top-loading can be obtained by adding capacitance at the top of an antenna. The top-loading has three major benefits. The first is that the top-loading increases the vertical current moment of the antenna, which increases the radiation resistance of the antenna to thereby increase the antenna's radiation efficiency. For electrically short monopole antennas, this radiation resistance can be theoretically increased by up to a factor of four. The top-loading additionally decreases the feed point reactance of the antenna, which decreases the feed point voltage for a given input current. This has the effect of increasing the power handling capability of the antenna. The amount of this increase is theoretically very large. A final benefit is that the increased capacitance of the top-load causes a decrease in the inherent Q factor of the antenna system, resulting in an increased antenna bandwidth.

The United States Navy has several shore-based high power transmitting antennas that operate in the very low frequency (VLF) and low frequency (LF) bands. All of these antennas are top-loaded monopoles. The antennas are of various designs, but about half of them are umbrella top-loaded monopole (UTLM) antennas.

The UTLM antenna includes a single base-insulated tower usually supported by insulated structural guy wires. The top-load is provided by active guy wires attached to the top of the antenna structure. Each of these active guy wires is electrically connected to the antenna tower. The active portion of the guy wire terminates in a high voltage insulator with the remainder of the wire being connected through break-up insulators to a ground anchor. FIGS. 1 and 2 illustrate a UTLM antenna.

In FIG. 1, UTLM antenna 10 is shown to include an antenna tower 12 that is supported substantially vertically by guy wires 14 attached to top 16 of the tower. At base 18 of tower 12 is a base insulator 20 that insulates the tower from ground. Guy wires 14 typically have an upper section 22 and lower section 24. When upper section 22 is activated through electrical connection to tower 12, section 22 is often called an "active radial" or "top-load radial". Active radial 22 will be insulated from lower section 24 of guy wire 14 by a main top-load insulator-coupler 26. Lower section 24, also known as a support halyard, often includes break-up insulators 28 and a ground anchor 30 that is secured into the ground outlying the tower.

The umbrella top-loaded monopole antenna illustrated in FIG. 1 can be described by three frequency independent parameters: static capacitance (Co); effective height (he); and self-resonant frequency (fo). The equivalent circuit derived from these parameters is a simple series-tuned circuit with one resonance. The circuit parameters of: static capacitance (Co); self-inductance (Lo); and radiation resistance (Rr) are derived from these frequency independent parameters.

Simple formulas are derived from this circuit for maximum radiated power (Pmax) and intrinsic bandwidth (BWo) (100% efficiency bandwidth). These formulas show that Pmax is proportional to $(he*Co)^2$ or approximately the square of the effective top-load area. Intrinsic bandwidth (BWo) is proportional to $(he^2*Co)$ or approximately the volume under the top-load. Both are proportional to the frequency to the fourth power as described in Hansen, Peder M., "High Power Very Low Frequency/Low Frequency Transmitting Antennas", Paper Number 56.5.1, vol. 3, 1990 Milcom Conference Record.

Design information for the UTLM antenna is available in several publications such as Devaney, T. E., R. F. Hall, and W. E. Gustafson, "Low-Frequency Top-Loaded Antennas", Naval Electronics Laboratory Technical Report 1381, 22 Jun. 1966; Watt, A. D., *VLF Radio Engineering*, Pergamon Press, 1967; and Belrose, J. S., "VLF, LF and MF Antennas", Chapter 15, *The Handbook of Antenna Design*, Peter Peregrinus Ltd., Belrose Book, 1986.

Referring now to FIG. 3, for a half cone angle θ of the top-load radials 22, the effective height of the UTLM antenna first increases as its active radial length increases, reaches a maximum and then decreases. The static capacitance of the antenna continuously increases with an increase in active radial length.

Referring again to FIG. 3, a parameter often used to describe a UTLM antenna is h'/h. The value of h' is the projected length of the monopole as covered by the top-load. This parameter has the value 0 for an antenna without top-load radials and 1 if the antenna has radials that reach all the way to the ground. Effective height, and therefore efficiency, is considered maximum when h'/h is approximately 0.3. Intrinsic bandwidth, or the bandwidth an antenna will have if it is 100% efficient, is maximum when h'/h is approximately 0.7. The power handling capability of the antenna, assuming a fixed top-load voltage limit, is maximum when h'/h approaches 1.

For several reasons the United States Navy's UTLM antennas have been designed to operate at or near maximum bandwidth. As newer, higher powered, transmitters are being planned for these existing antennas, there is a possibility of exceeding the antennas top-load voltage limitations. As a result, there is a need to increase the top-load voltage limits of these antennas without requiring their complete reconstruction.

The voltage limit of a top-load is reached when the top-load wires go into corona. The corona forms when the surface electric field (potential gradient) of the wires exceeds the breakdown strength of air. Corona causes power loss and radio interference/noise. The effects of corona, especially power loss, are proportional to frequency. For VLF and even more so for LF antennas, it is undesirable to have any portion of a utilized antenna in corona as it is known that at VLF and LF even a small amount of wire in corona can dissipate a large amount of power.

The onset of corona on a wire is determined by the maximum surface electric field on the wire. The critical field resulting in corona onset ($E_o$) is a function of local radius of curvature, air density, surface roughness, frequency, moisture presence, and to a lesser extent many other things. Typical design values for wire sizes used in VLF/LF antennas vary between 0.7 kV/mm and 0.9 kV/mm.

The current distribution I(z) or charge distribution Ql(z) on an antenna can often be determined. If the current distribution is known, the charge density can be derived from conservation of charge:

$$Ql(z)=(1/\omega)*dI/dz.$$

Where $\omega$=radian frequency z=dimension along wire

If the charge distribution is known then by Gauss's law the surface electric field (Es) on the wire is:

$$Es=Ql/(2*\pi*\epsilon_o*a).$$

Where $\epsilon_o$=permeability of free space a=radius of wire $\pi$=3.14159

The charge distribution on the top-load radials of a typical umbrella monopole antenna can be approximated by a linear function with zero charge at the tower top. A plot of surface electric field (Es) for a typical umbrella top-loaded monopole is given in FIG. 4. As can be seen in the figure, where a wire ends abruptly, the charge at the end of the wire significantly increases. The addition of an appropriately sized corona ring can mitigate this effect.

From the figure, it can be seen that the wire in the vicinity of the end of an active top-load radial will go into corona first. This will create a fundamental limit on the power handling capability of the antenna. To increase this limit, the wire diameter can be increased; however, the largest currently available commercial stranded conductor, such as ALUMOWELD, has a nominal diameter of 1.46 inches. This diameter, however, may not be adequate to limit the surface gradient of top-loading radials to an acceptable value. Another practical solution is to increase the effective diameter of the outer portion of the radials by the paralleling/caging of two or three conductors. This, however, requires additional hardware, adds weight and windage to the wires and increases the cost, complexity and maintenance of the antenna system.

SUMMARY OF THE INVENTION

In a UTLM antenna, the charge distribution on top-load radials increases approximately linearly away from the top of the antenna tower. This is because the activated wires are separating from the tower and each other at the same time they are getting closer to ground.

The umbrella top-loaded monopole antenna design of the invention incorporates a top-load configuration in which top-load elements are arranged in frames. The frames originate at the top end of the antenna and extend away from the antenna towards the antenna's base where, as the top-load elements approach the end of the top-load, they come closer together and hence shield each other to thereby reduce charge density. These top-load frames may be arranged contiguously as in a rosette configuration. At those points of the configuration furthest from an antenna and closest to ground at least two top-load elements converge to provide the shielding effect. The self-shielding capability offered by the invention permits an antenna to operate at considerably higher voltage. This configuration can also exhibit superior effective height and static capacitance as compared to the traditional UTLM antenna. Because of the efficiency offered by the invention, intrinsic bandwidth and radiated power can be superior to the typical UTLM antenna even with the same top-load voltage limit. Such results can be achieved with half of the traditional number of top-load high voltage insulators providing an economic system. The top-load elements of this new top-load configuration can also be easily connected to de-icing equipment.

OBJECTS OF THE INVENTION

An object of this invention is to provide a top-load monopole antenna exhibiting a superior effective height as compared to a typical top-loaded monopole antenna.

Another object of this invention is to provide a top-load monopole antenna exhibiting a superior static capacitance as compared to a typical top-loaded monopole antenna.

Yet another object of this invention is to provide a top-load monopole antenna that exhibits a superior intrinsic bandwidth as compared to a typical top-loaded monopole antenna.

Still another object of this invention is to provide a top-load monopole antenna that exhibits a superior radiated power as compared to a typical top-loaded monopole antenna.

Yet still another object of this invention is to provide a top-load monopole antenna that exhibits a superior top-load voltage limit as compared to a typical top-loaded monopole antenna.

Another object of this invention is to provide a top-load monopole antenna that decreases the number of top-load voltage insulators as compared to a typical top-loaded monopole antenna.

Yet still another object of this invention is to provide a top-load monopole antenna that is configured for easy de-icing.

Still another object of the invention is to provide a top-load for an antenna that provides all the usual benefits of top-loading i.e. increased effective height/efficiency, increased bandwidth and decreased operating voltage, while at the same time allows more power to be radiated for a given size antenna and top-load.

These and other objects of the invention will become apparent from the ensuing specification when considered together with the accompanying drawings.

DESCRIPTION OF THE PREFERRED EMBODIMENT

Figure 4:
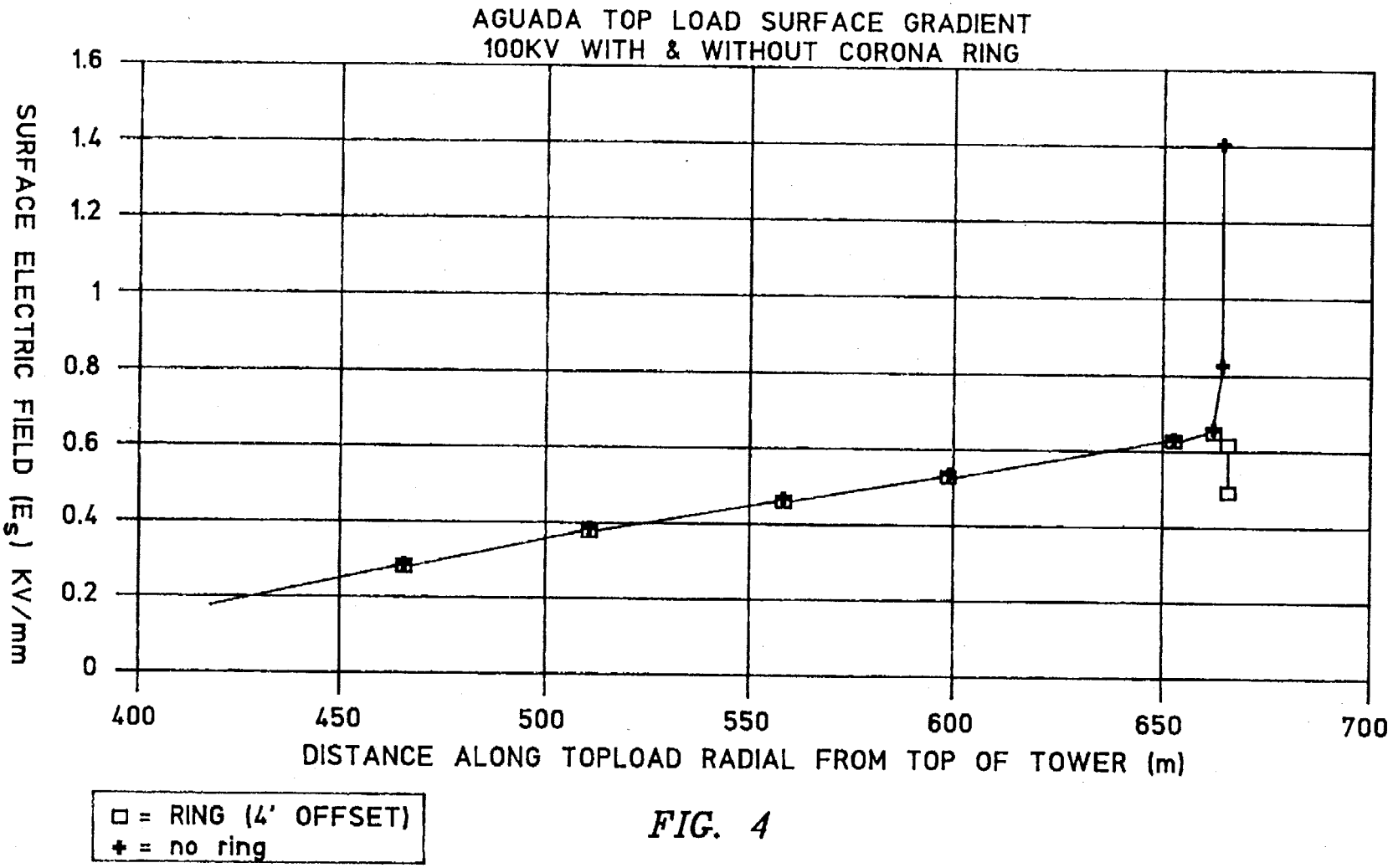
In FIG. 4 a graph of surface electric field versus top-load radial distance is shown for a typical UTLM antenna.

Referring once again to FIG. 4 a plot of charge distribution for a typical umbrella top-loaded monopole is illustrated. At the ends of the top-loaded radials furthest from a tower, it can be seen that the charge distribution over the radials significantly increases. The wire in the vicinity of the end of the active top-load radials will be the first to go into corona. This poses a fundamental limit on the power handling capability of an antenna. The charge distribution increases approximately linearly from the top of the UTLM antenna because the wires are separating not only from the tower as well as each other but also are getting closer to ground. The need for the active top-load elements to become closer together as they approach the end of the top-load, instead of further apart, became clear.

Figure 1:
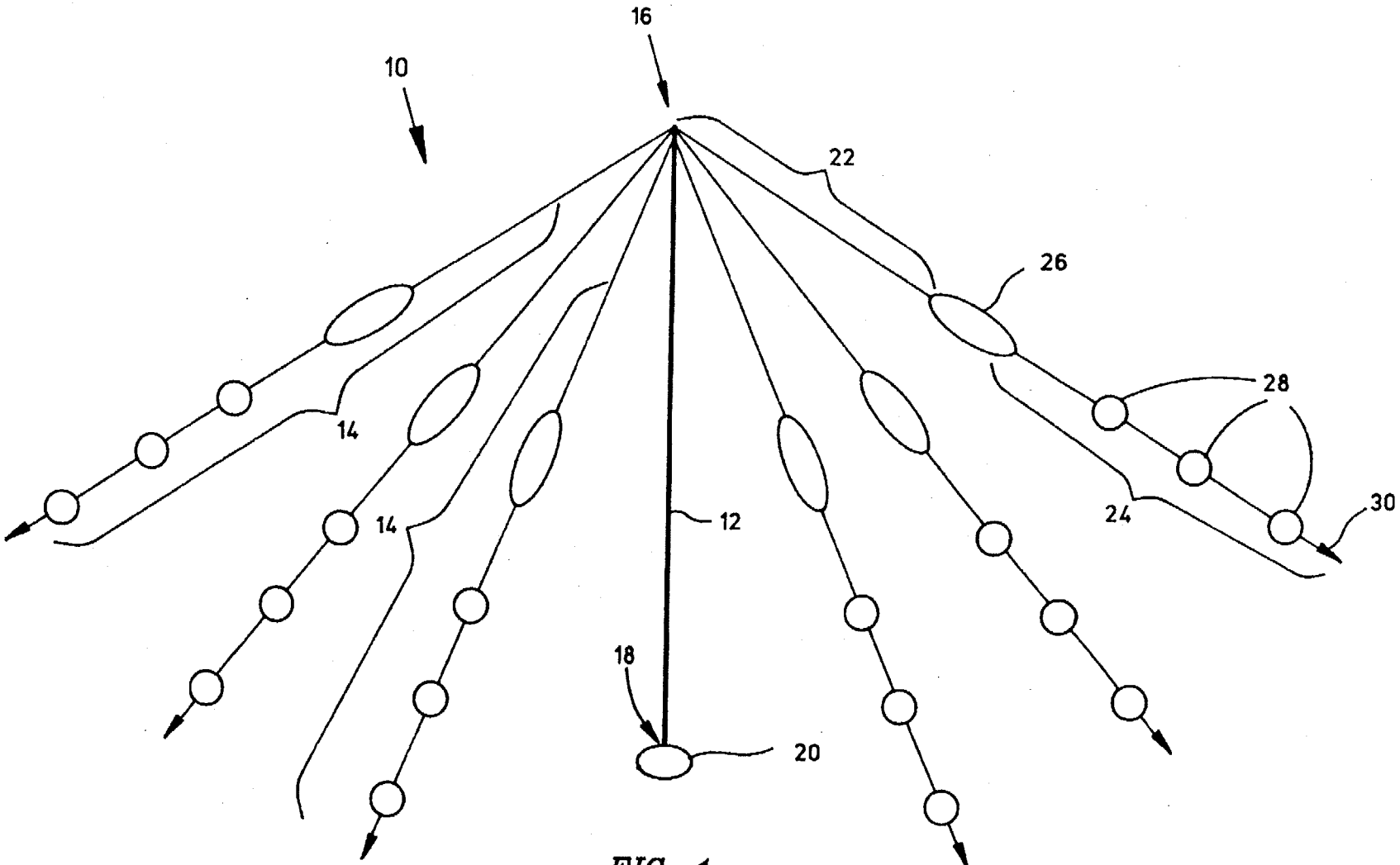
FIG. 1 illustrates a typical umbrella top-loaded monopole (UTLM) antenna.
Figure 5:
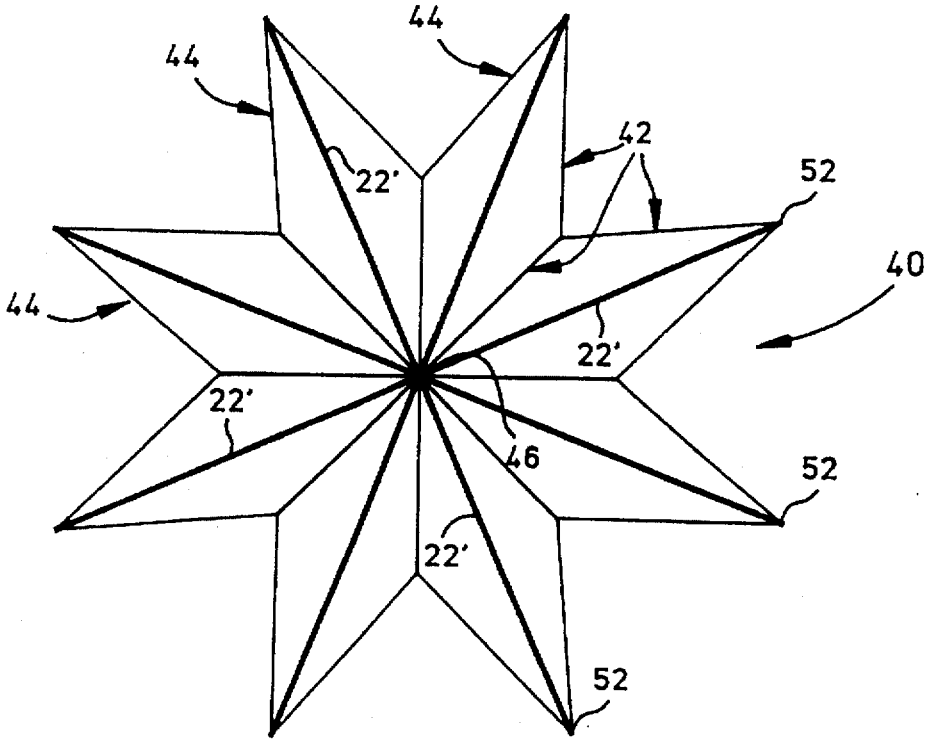
In FIG. 5 the active top-load element portion of a rosette shaped panel configured top-loaded monopole antenna is shown.
Figure 6:
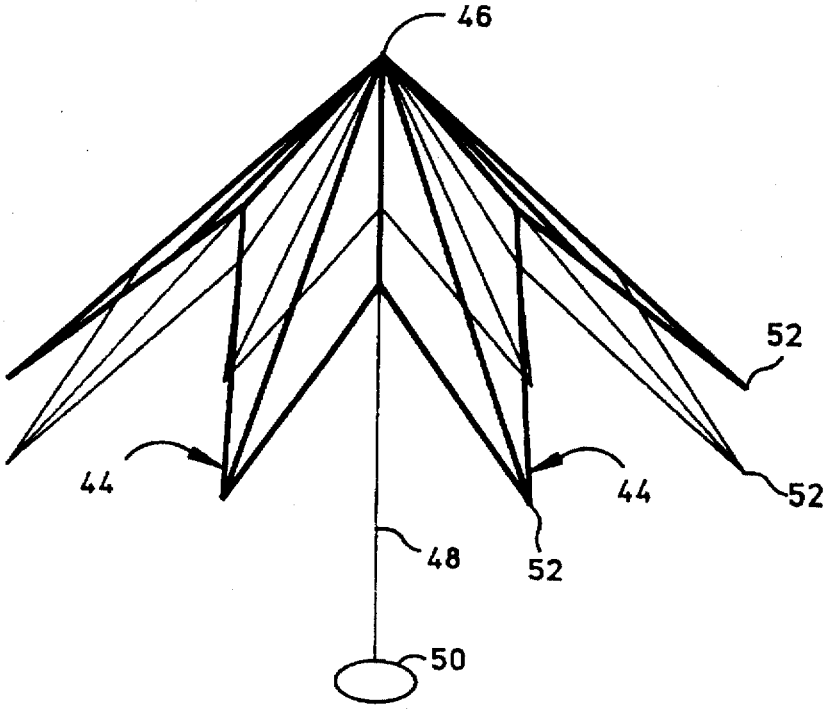
In FIG. 6 a side view of the rosette shaped top-loaded monopole antenna of FIG. 5 is shown, in which the active top-load radials and tower are illustrated.

In FIGS. 5 and 6, an antenna top-load configuration according to one embodiment of the invention is shown. In FIG. 5 antenna top-load configuration 40 takes the place of active top-load elements 22 of FIG. 1. In the embodiment shown, top-load configuration 40 is made from a number of top-load elements 42 arranged to form rhombic shaped frames 44. In this embodiment, frames 44 are disposed contiguously to make up a rosette configuration. As shown in FIGS. 5 and 6, frames 44 originate at top end 46 of antenna tower 48 and extend away from antenna tower 48 toward base 50 of the antenna to end at top-load end points 52 where two top-load radiating/receiving elements 42 converge. By converging these elements, they shield each other and thereby reduce the charge density at the ends of the top-load. Though a rosette-shaped top-load configuration having eight contiguous rhomic-shaped frames is shown, other antenna top-load configurations of a different number of frames and shapes are possible.

In the configuration shown in FIGS. 5 and 6, frames 44 need only be supported by their perimeter; however, the frames could be supported with other wires in various ways. One practical way is to include a single wire across the center of the frame that continues on to the ground anchor as a support guy. This embodiment is shown in FIGS. 5 and 6 where support guy 22' crosses the center of frame 44. Support guy 22' would be substituted for radials 22 of FIG. 1. Support guy 22' would then be attached to the main top-load insulator-couplers 26 and lower guy section 24 to be ultimately fastened to the ground through ground anchor 30. In this arrangement, support guy 22' could be used as an "active" antenna element to increase the static capacitance of the top-load.

Figure 3:
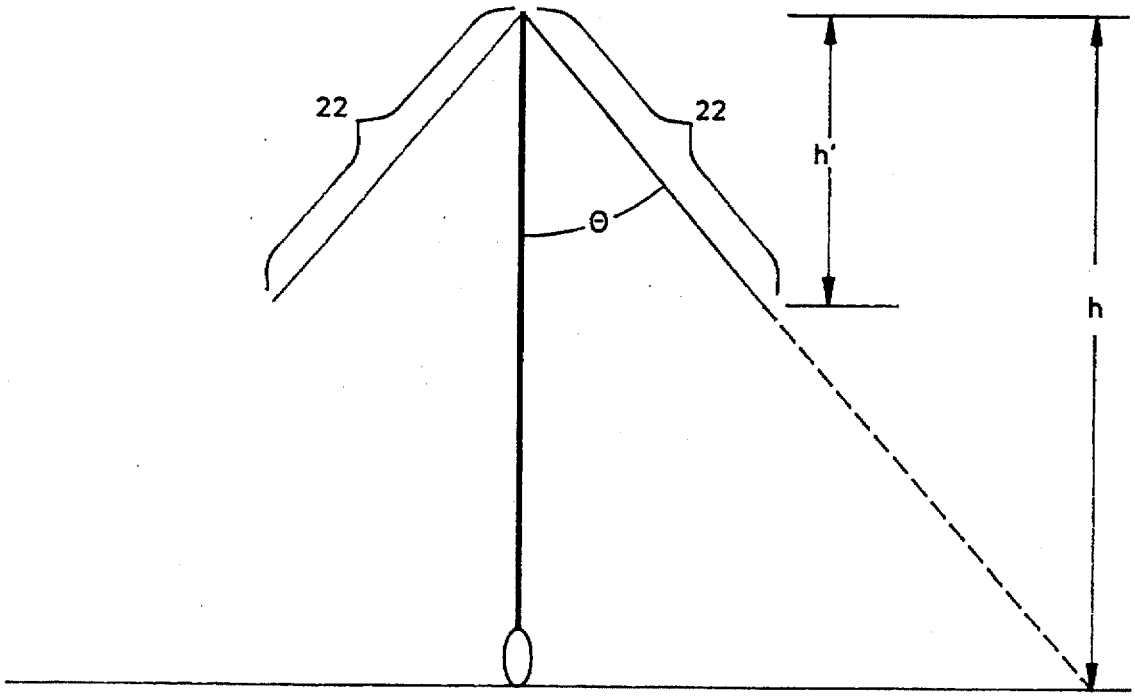
FIG. 3 illustrates design criteria of a typical UTLM antenna.
Figure 7:
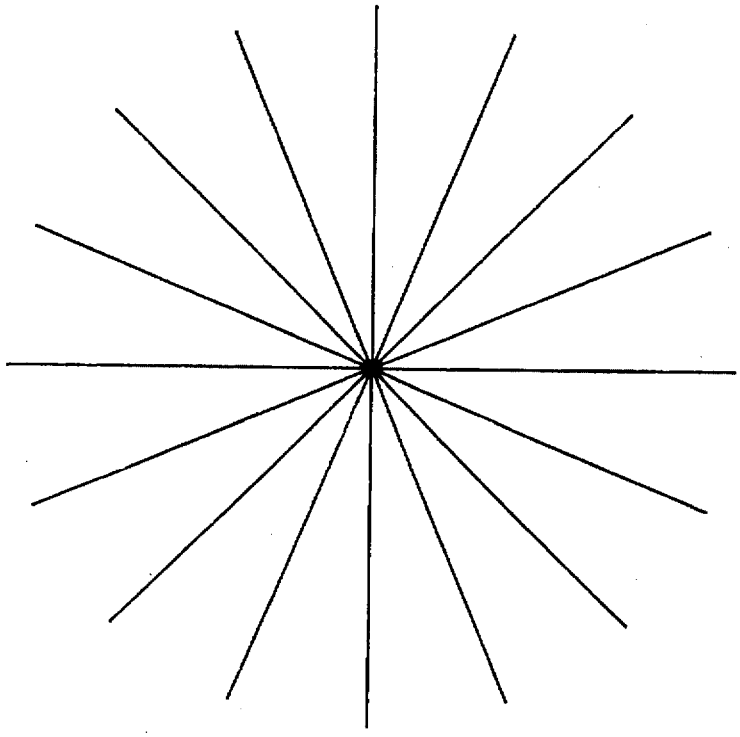
In FIG. 7 the active top-load radials of a typical sixteen radial UTLM antenna are shown.

A model of the rosette shaped umbrella top-loaded monopole antenna was constructed having eight frames each including the panel center wires. Using this model, measurements were made of the antenna's frequency independent parameters. At the same time, a model UTLM antenna with sixteen top-load radials having the same basic parameters as the rosette antenna (half cone angle and h'/h, as shown in FIG. 3) was modeled. In FIG. 7 a top view of the sixteen top-load radials of this antenna is shown. The results of both sets of measurements are given in Table 1 below.

TABLE 1

Model Measurements of Frequency Independent Parameters UTLM and Rosette Top-Loaded Monopole (Scaled for 1500 foot mast)

| Parameters | Rosette | UTLM |
|---|---|---|
| Static capacitance (nF) | 21.9 | 21.0 |
| Effective height (m) | 256 | 249 |
| Resonant frequency (kHz) | 52.6 | 52.0 |

From the table it can be seen that the rosette configuration is superior to that of the standard UTLM because both its effective height and static capacitance are greater. Because of this efficiency, intrinsic bandwidth and radiated power (Pmax) will be superior for the rosette antenna even with the same top-load voltage limit. This can be achieved with half the number of main top-load voltage insulators.

Figure 2:
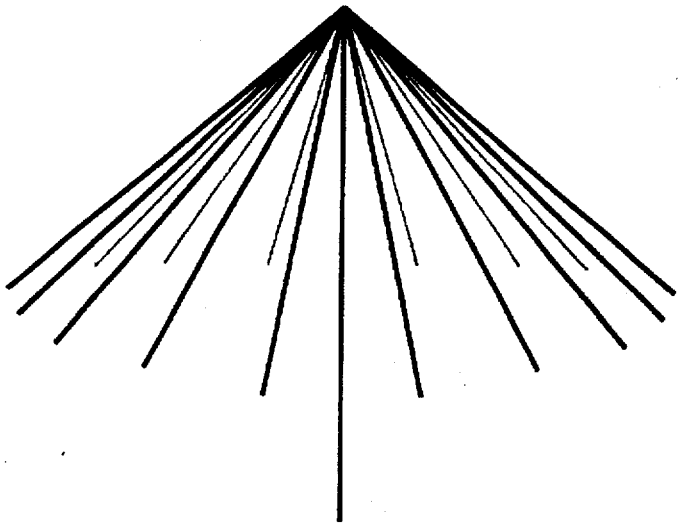
FIG. 2 is a side view of a UTLM antenna showing the tower and active radials only.
Figure 8:
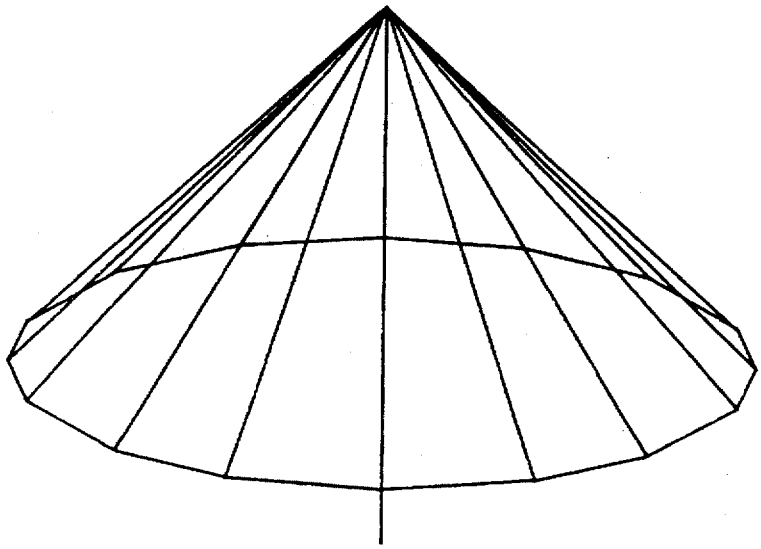
FIGS. 8 and 9 show side and top views, respectively, of the top-load of a sixteen-radial UTLM antenna equipped with an additional bus connecting the ends of the top-load radials.
Figure 9:
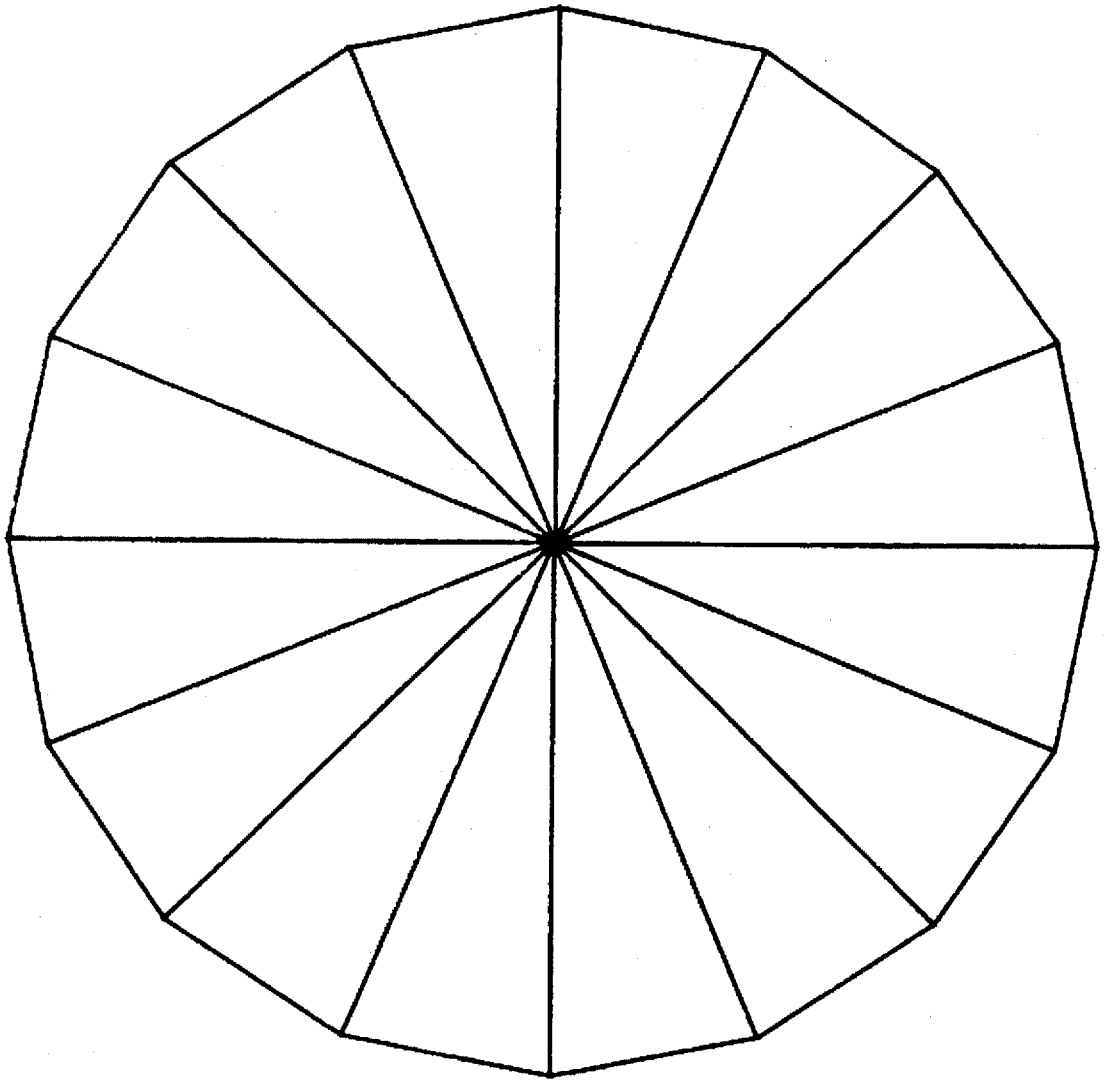
Figure 10:
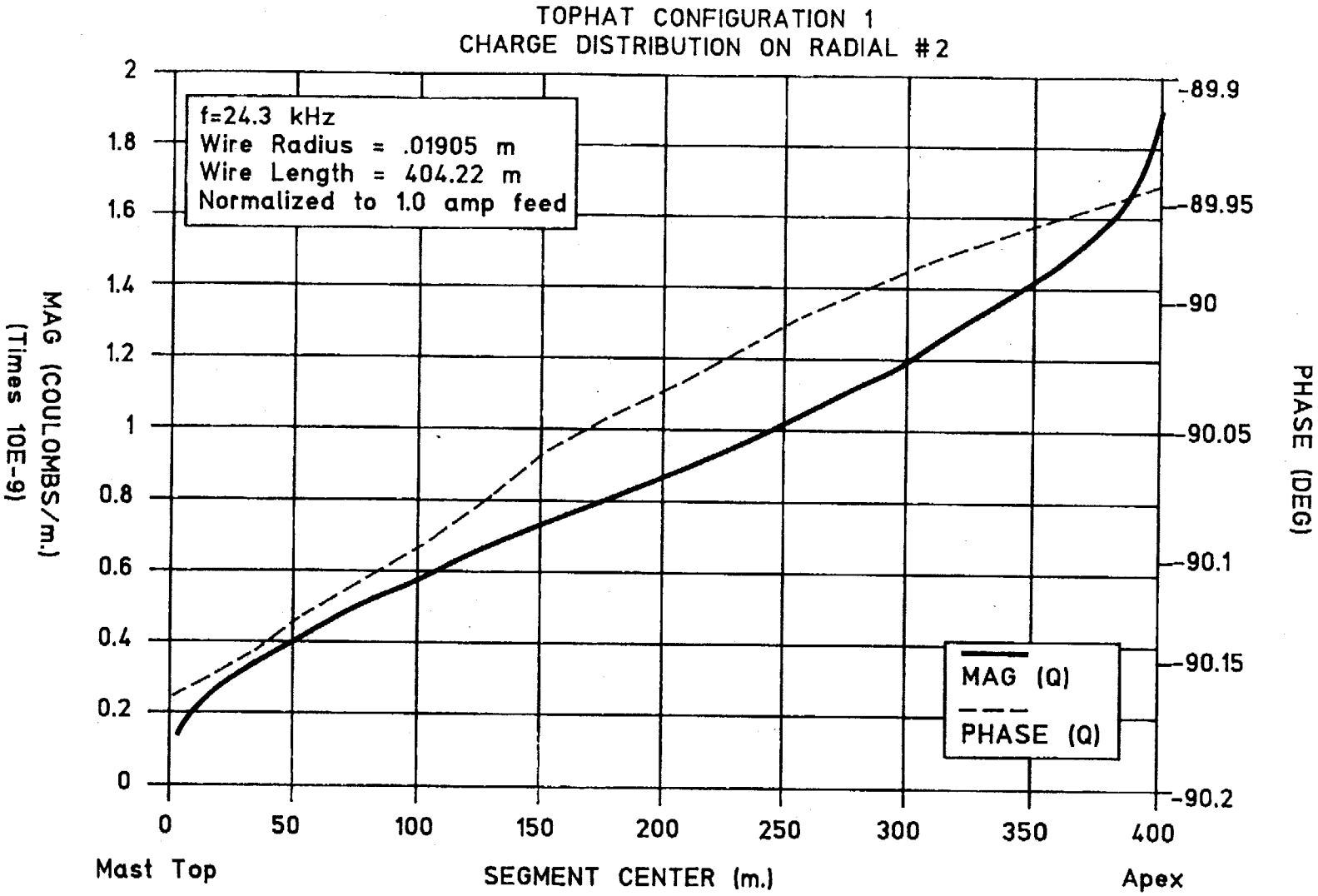
FIGS. 10–14 are charge distributions for standard, standard with bus, and rosette top-load configurations.
Figure 11:
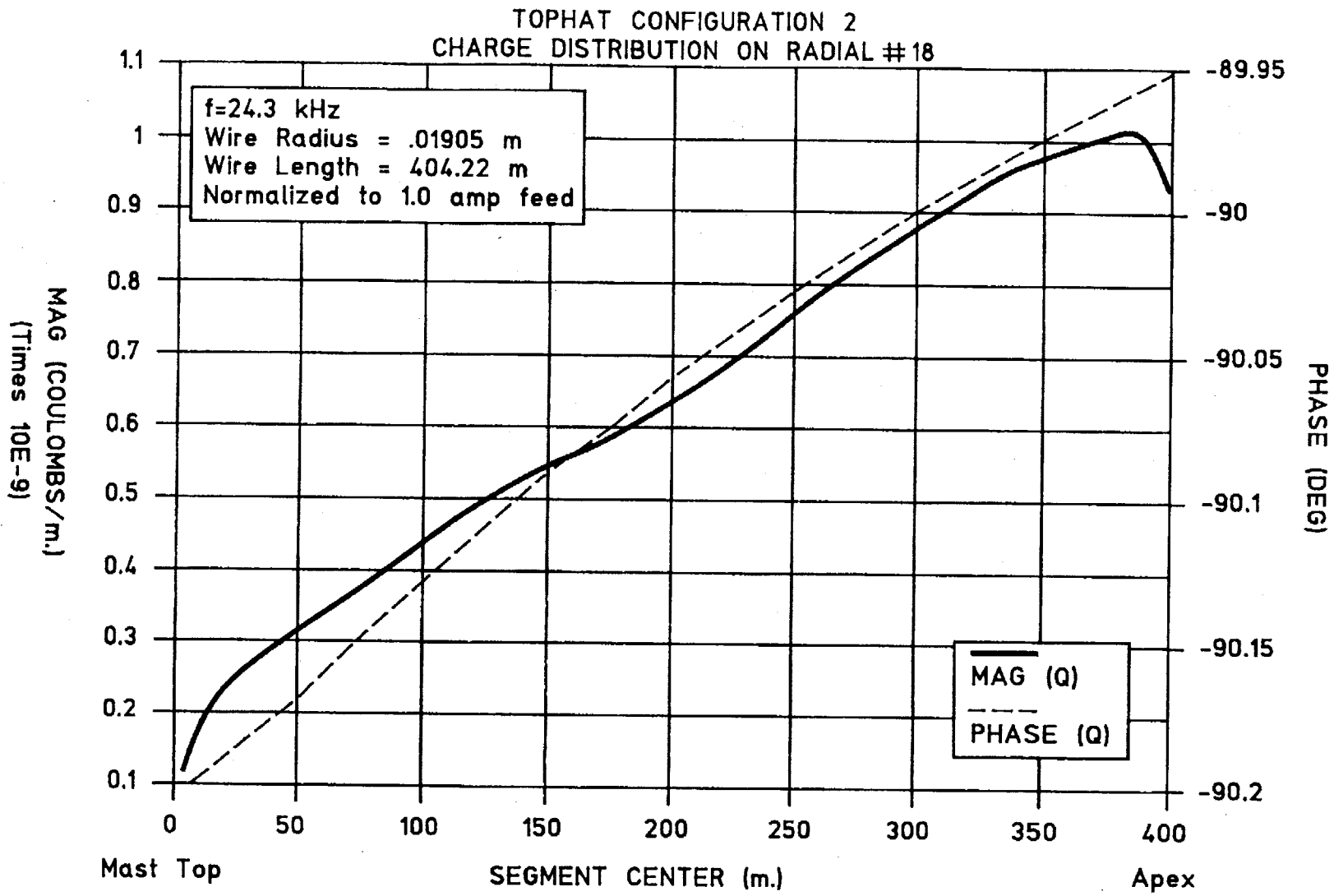
Figure 12:
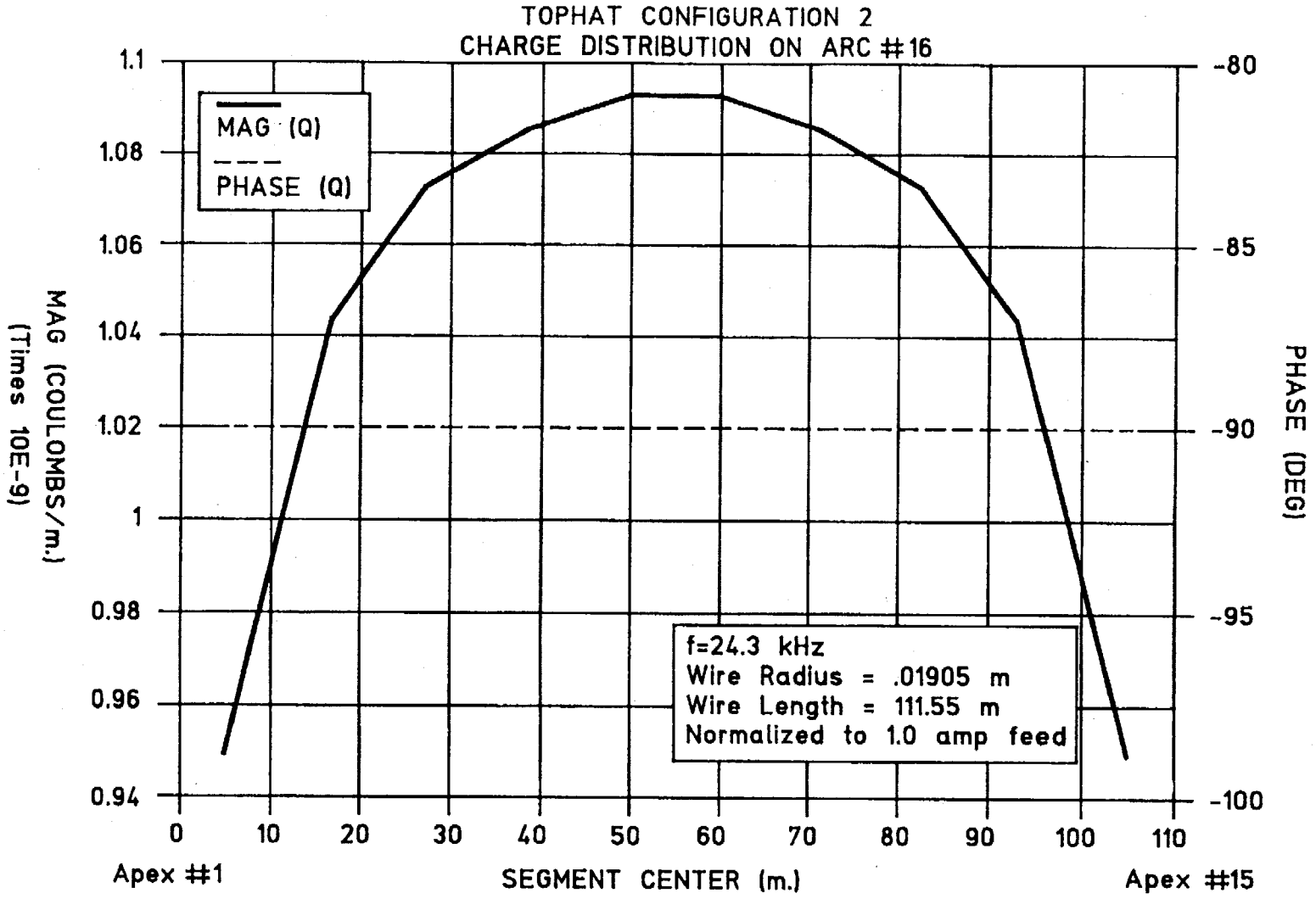
Figure 13:
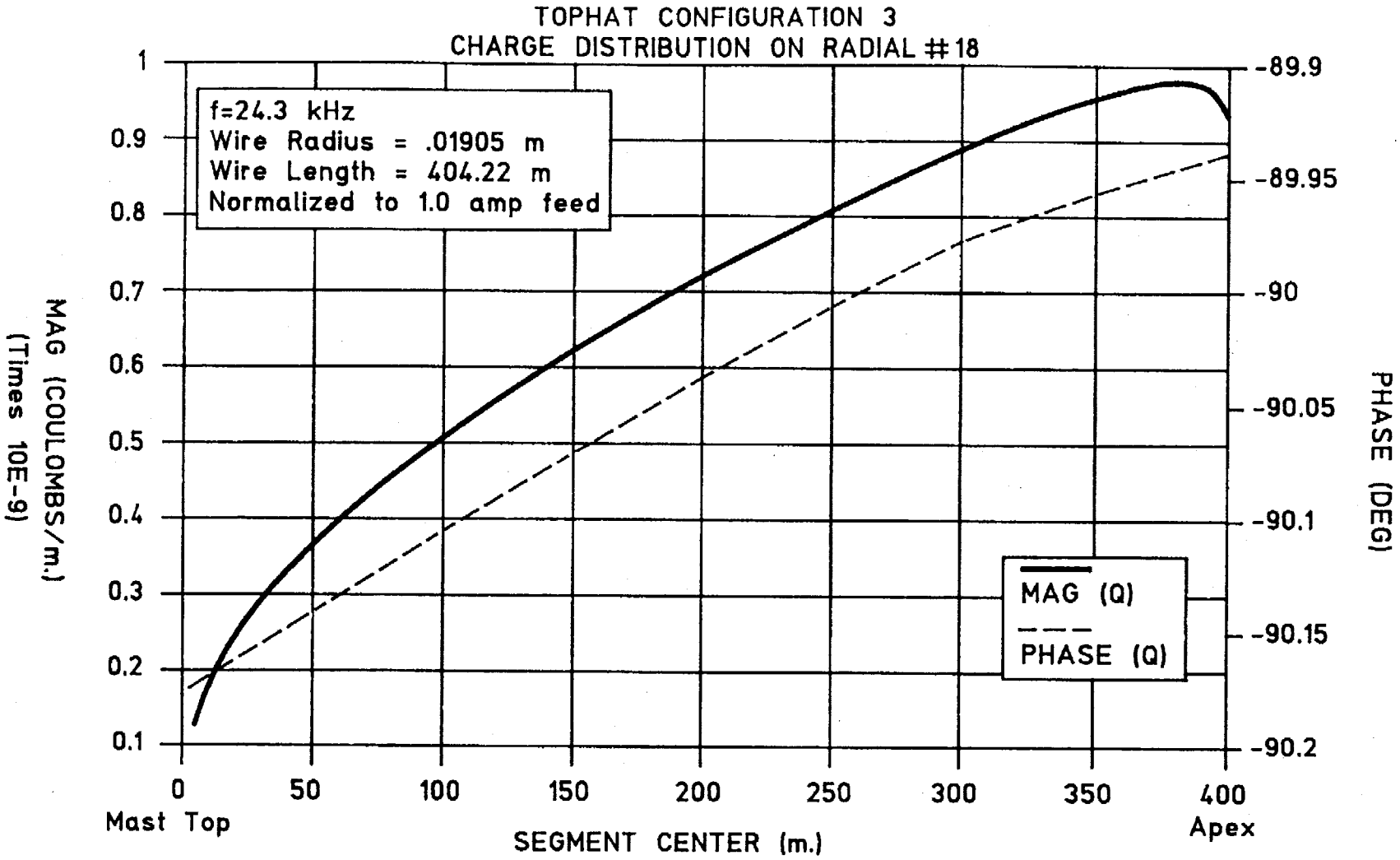
Figure 14:
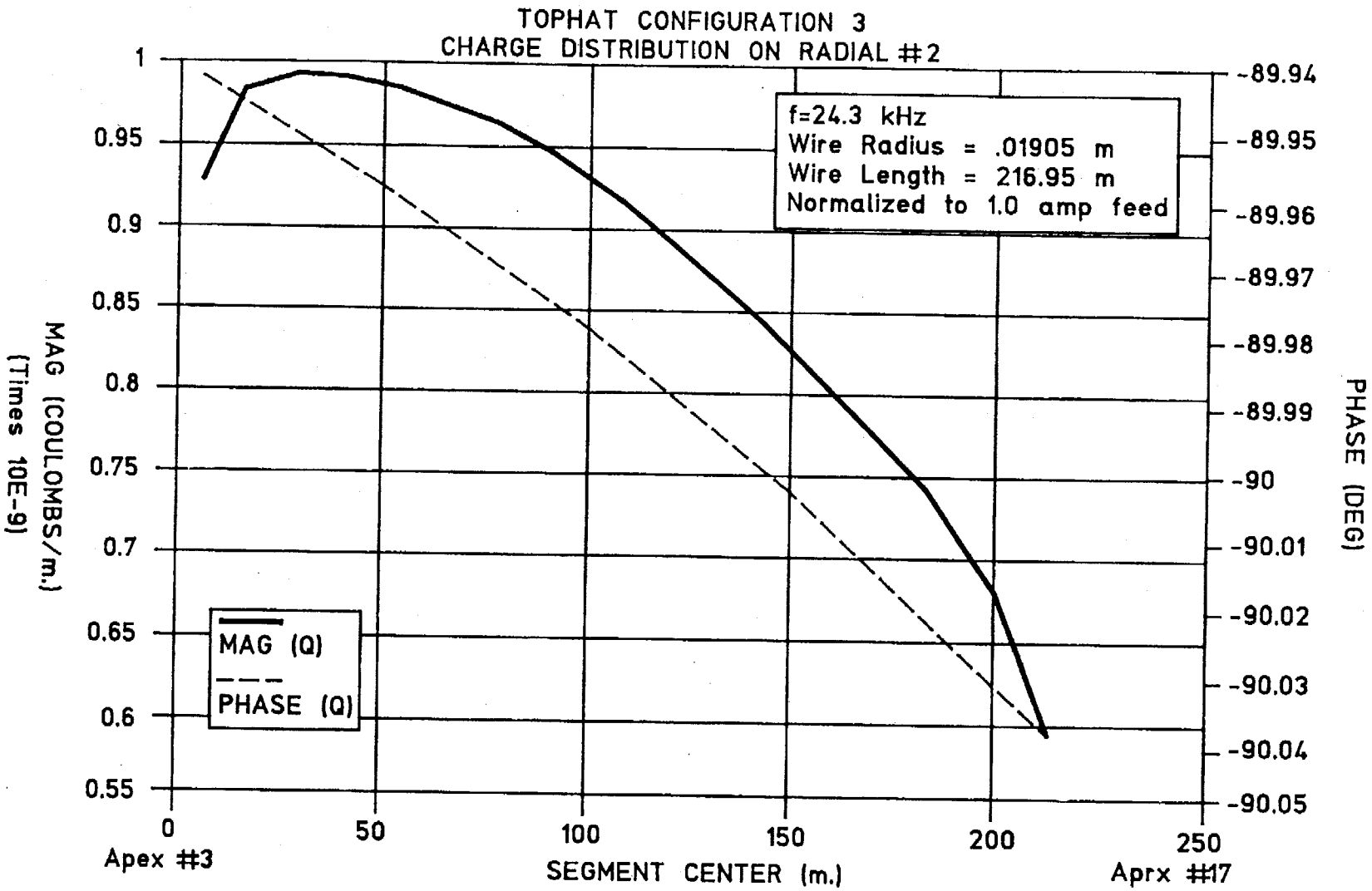

In order to determine the effectiveness of the self-shielding at the ends of the top-load of the frame-shaped top-load configuration, a computer program known as the Numerical Electromagnetic Code (NEC) written by the Lawrence Livermore National Laboratory, was used to calculate the charge distribution on three top-load configurations. Configuration 1 is the standard sixteen radial UTLM antenna as shown in FIGS. 2 and 7. The second configuration is the same except with the addition of a bus connecting the ends of the radials. See FIGS. 8 and 9. The third configuration is an eight-frame rosette top-load of similar dimensions, see FIGS. 5 and 6. In this modeling, the mast height (h) is 1500 feet, the length of the top-load is 1,000 meters and the half cone angle is 45°, see FIG. 3. The value of h'/h is, in this instance, 0.625. The antennas were modeled at 23.4 kHz. Plots of the charge distribution for 1 amp input current are given in FIGS. 10–14.

Table 2 contains a summary of the generated data. Qmax is the maximum charge near the end of the top-load configuration taken from the plots of FIGS. 10–14. For the UTLM antenna, the actual charge at the end of the top-load radial would exceed 2 nano-coulombs/m (nC/m) with no corona ring. With an appropriately sized ring, the charge is conservatively estimated from FIG. 10 to be 1.6 nC/m. The UTLM antenna plus perimeter bus has two charge numbers, the first one is taken near the end of the top-load radial and the second is taken at the center of one section of the bus. All the charge numbers are for 1 amp input to the antennas.

TABLE 2

NEC Data for Three Top-Loaded Monopole Configurations

| | UTLM | UTLM + Bus | Rosette |
|---|---|---|---|
| Zin(23.8kHz) | .727–j257 | .611–j197 | .724–j235 |
| Effective height (m) | 259 | 238 | 259 |
| Qmax (nC/m) | 1.6 | 1.01, 1.09 | .99 |
| Pmax | 1.0 | 1.81 | 2.60 |

The modeling shows that the UTLM antenna plus bus has a reduced effective height even though the input reactance is lower thereby indicating an increase in static capacitance. The rosette and UTLM antenna configurations have essentially the same effective height.

The row labeled Pmax is a comparison of normalized radiated power for the same maximum charge density on the top-load configuration. The power has been normalized to that radiated by the UTLM antenna. Note that the addition of the perimeter bus does increase the radiated power capability (Pmax), however, the rosette antenna configuration with the same dimensions can radiate 260% more power than the UTLM antenna for the same limiting value of surface electric field from the top-load configuration.

The UTLM antenna modeled had sixteen top-load radials. Note that a UTLM antenna with 8 top-load radials would have twice the charge density at the end of the radials. For this case the same rosette antenna could radiate approximately 4*2.6 =10.4 times as much power as the UTLM antenna configuration.

The frame arranged top-load configuration of the invention is inherently self-shielding near the ends of the top-load where surface electric field is highest. Such an arrangement permits considerably higher top-load antenna voltage capability. The associated increase in power handling capability over that of the typical UTLM antenna is more than a factor of 2 and may be more than a factor of 10 in some cases. The top-load configuration of the invention also has the advantage of fewer top-load insulators thereby saving in construction and maintenance costs. In addition, the invention lends itself to easy deicing as the interconnected frame configuration can be easily energized for this purpose.

Figure 15:
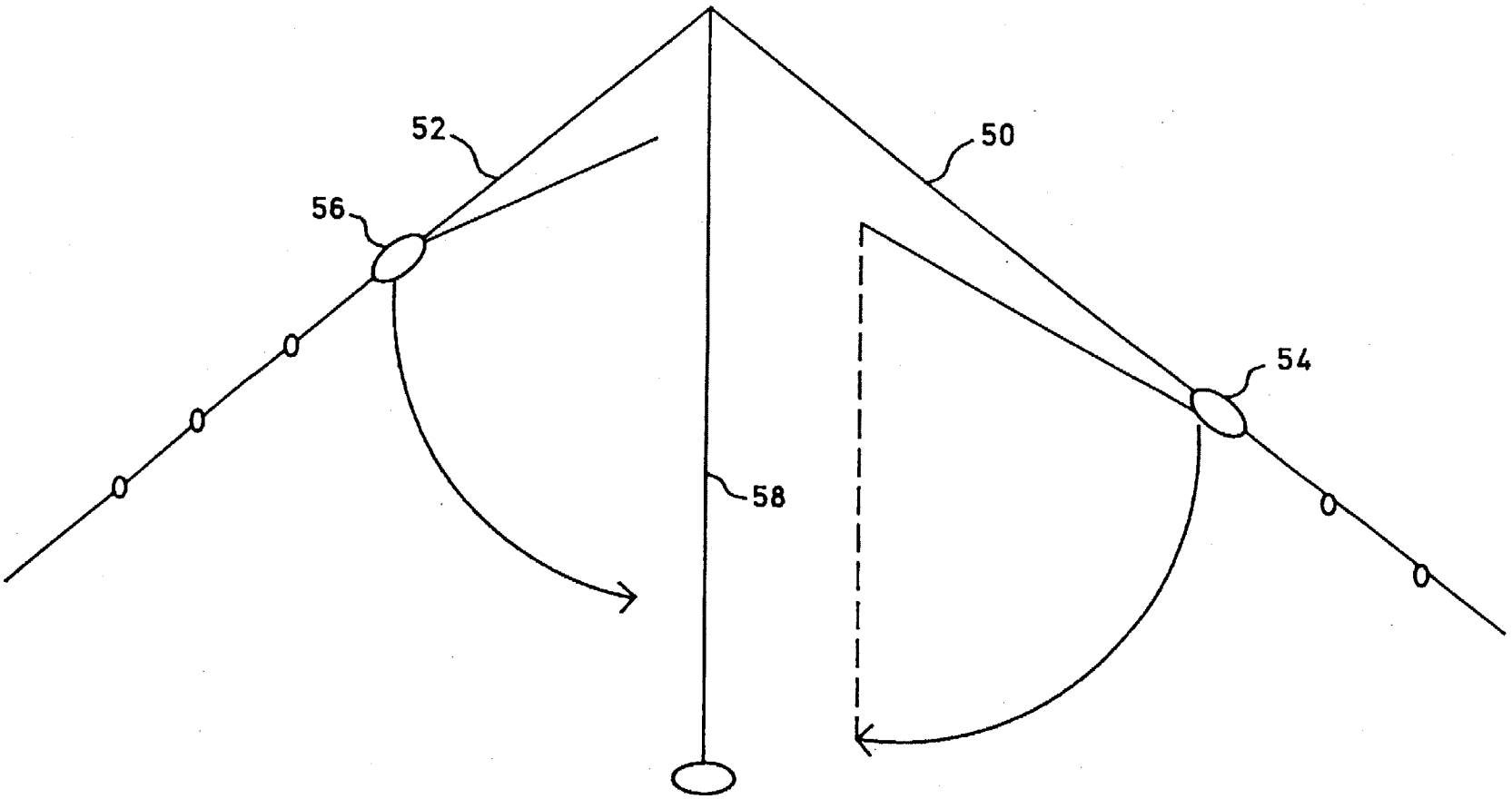
FIG. 15 illustrates two embodiments of the invention designed for easy maintenance.

In FIG. 15 there are shown two alternative embodiments showing how active radials 50 and 52 as may be used in the invention can be varied in length to enhance the ease of construction and maintainability of the invention. For example, radial 50 can be designed to be long enough to permit main insulator 54 to be swung down to the ground for maintenance. A second example shown in this figure involves designing radial 52 so that slacking off on a single guy permits insulator 56 be swung into tower 58 for maintenance.

Obviously, those skilled in the art will realize that these and other modifications and variations of the invention are possible in light of the above teachings. Therefore, it is to be understood that within the scope of the following claims the invention may be practiced otherwise than as specifically described.

What is claimed is:

1. An apparatus comprising:

an antenna having a top end and a base; and an antenna top-load configuration operably coupled to said antenna including a plurality of top-load elements arranged to form rhombic-shaped frames that originate at said top end of said antenna and that extend away from said antenna towards said base of said antenna to end at a top-load end point where two or more of said top load elements converge.

2. An apparatus according to claim 1 in which said antenna is a substantially vertically disposed monopole antenna.

3. An apparatus according to claim 2 in which said monopole antenna is a base-insulated monopole antenna.

4. An apparatus according to claim 1 in which said top-load elements are radiating/receiving elements.

5. An apparatus according to claim 1 in which said frames are disposed contiguous to each other.

6. A monopole antenna apparatus comprising:

a substantially vertically disposed base-insulated monopole antenna having a top and a base; and an antenna top-load configuration including a plurality of top-load radiating/receiving elements arranged to form contiguous rhombic-shaped frames that originate at said top of said antenna and that extend away from said antenna towards said base of said antenna to end at a top-load end point where two or more of said top load elements converge.

7. An apparatus according to claim 6 wherein said top-load configuration is energized by said antenna.

8. A monopole antenna apparatus according to claim 6 in which said monopole antenna is kept substantially vertical through the aid of a plurality of guy wires.

9. A monopole antenna apparatus according to claim 8 in which said guy wires have upper and lower sections divided by an insulating coupling.

10. A monopole antenna apparatus comprising:

a base-insulated monopole antenna having a top and a base, said antenna being kept substantially vertically through the aid of a plurality of guy wires; and an antenna top-load configuration energized by said antenna and including a plurality of top-load radiating/receiving elements arranged to form contiguous rhombic-shaped frames that originate at said top of said antenna and that extend away from said antenna towards said base of said antenna to end at a top-load end point where two or more of said top load elements converge.

11. A monopole antenna apparatus according to claim 10 in which said guy wires have upper and lower sections divided by an insulated coupling.

12. A monopole antenna apparatus according to claim 11 in which at least some of said upper sections of said guy wires are also used as top-load elements.

13. A monopole antenna apparatus comprising:

a base-insulated monopole antenna having a top and a base, said antenna being kept substantially vertically through the aid of a plurality of guy wires in which said guy wires have upper and lower sections divided by an insulating coupling; and an antenna top-load configuration energized by said antenna and including a plurality of top-load radiating/receiving elements arranged to form contiguous rhombic-shaped frames that originate at said top of said antenna and that extend away from said antenna towards said base of said antenna to end at a top-load end point where two or more of said top load elements converge, at least some of said upper sections of said guy wires also being used as top-load elements.

* * * * *